US010440483B2

(12) United States Patent
Ruaro

(10) Patent No.: US 10,440,483 B2
(45) Date of Patent: Oct. 8, 2019

(54) HEARING AID WITH IMPROVED WIRELESS COMMUNICATION

(71) Applicant: GN HEARING A/S, Ballerup (DK)

(72) Inventor: Andrea Ruaro, Copenhagen (DK)

(73) Assignee: GN HEARING A/S, Ballerup (DK)

( * ) Notice: Subject to any disclaimer, the term of this patent is extended or adjusted under 35 U.S.C. 154(b) by 0 days.

(21) Appl. No.: 14/954,163

(22) Filed: Nov. 30, 2015

(65) Prior Publication Data

US 2017/0150278 A1 May 25, 2017

(30) Foreign Application Priority Data

Nov. 25, 2015 (DK) ..... 2015 70757
Nov. 25, 2015 (EP) ..... 15196261

(51) Int. Cl.
*H04R 25/00* (2006.01)

(52) U.S. Cl.
CPC ..... *H04R 25/554* (2013.01); *H04R 25/552* (2013.01); *H04R 25/60* (2013.01); *H04R 2225/025* (2013.01); *H04R 2225/51* (2013.01)

(58) Field of Classification Search
None
See application file for complete search history.

(56) References Cited

U.S. PATENT DOCUMENTS 6,326,921 B1 * 12/2001 Egorov ..... H01Q 1/36 343/700 MS
7,742,614 B2 * 6/2010 Christensen ..... H01Q 1/273 320/108
7,825,861 B2 * 11/2010 Sato ..... H01Q 1/243 343/702
2004/0196996 A1 * 10/2004 Feitel ..... H04R 25/65 381/322
2005/0099341 A1 * 5/2005 Zhang ..... H01Q 1/273 343/700 MS (Continued)

FOREIGN PATENT DOCUMENTS

EP 2 458 674 A2 5/2012
EP 2 675 189 A1 12/2013

(Continued)

OTHER PUBLICATIONS

Extended European Search Report dated Apr. 14, 2016 for corresponding EP Patent Application No. 15196261.0, 10 pages.

(Continued)

*Primary Examiner* — Matthew A Eason
*Assistant Examiner* — Taunya McCarty
(74) *Attorney, Agent, or Firm* — Vista IP Law Group, LLP

(57) ABSTRACT

An in-the-ear hearing aid, the hearing aid having a first end and a second end, the hearing aid includes: a microphone configured to receive sound; a processing unit configured to provide a processed audio signal for compensating a hearing loss of a user; an output transducer for providing an acoustic output, wherein the microphone and the output transducer are coupled to the processing unit; an antenna that is closer to the first end than to the second end of the hearing aid; a wireless communication unit coupled to the antenna; and a polarization element configured for forming a polarization of the antenna, where the polarization element is between the first end and the second end of the hearing aid.

38 Claims, 4 Drawing Sheets

(56) References Cited

U.S. PATENT DOCUMENTS

| | | | | |
|---|---|---|---|---|
| 2005/0232454 | A1 | 10/2005 | Niederdrank et al. | |
| 2006/0017624 | A1* | 1/2006 | Nagano | H01Q 1/243 343/702 |
| 2010/0321269 | A1* | 12/2010 | Ishibana | H01Q 1/273 343/834 |
| 2012/0093324 | A1* | 4/2012 | Sinasi | H01Q 1/273 381/23.1 |

FOREIGN PATENT DOCUMENTS

| | | | |
|---|---|---|---|
| EP | 2 680 366 | A1 | 1/2014 |
| EP | 2 458 674 | A3 | 4/2014 |
| EP | 2 827 613 | A1 | 1/2015 |
| EP | 2 985 834 | A1 | 2/2016 |
| WO | WO 2005/081583 | A1 | 9/2005 |

OTHER PUBLICATIONS

First Technical Examination and Search Report dated Jun. 8, 2016 for corresponding Danish Patent Application No. PA 2015 70757, 8 pages.

* cited by examiner

HEARING AID WITH IMPROVED WIRELESS COMMUNICATION

RELATED APPLICATION DATA

This application claims priority to, and the benefit of, Danish Patent Application No. PA 2015 70757 filed Nov. 25, 2015, pending, and European Patent Application No. 15196261.0 filed Nov. 25, 2015, pending. The entire disclosures of both of the above applications are expressly incorporated by reference herein.

FIELD

The present disclosure relates to an in-the-ear hearing aid, the hearing aid having a first end and a second end. In particular, the hearing aid comprises a microphone configured to receive sound, a processing unit configured to provide a processed audio signal for compensating a hearing loss of a user, an output transducer for providing an acoustic output, and an antenna and a wireless communication unit for wireless communication.

The hearing aid may be used in a binaural hearing aid system. During operation, the hearing aid is worn in the ear of a user.

BACKGROUND

Hearing aids are very small and delicate devices and comprise many electronic and metallic components contained in a housing or shell small enough to fit in the ear canal of a human or be located behind the outer ear. The many electronic and metallic components in combination with the small size of the hearing aid housing or shell impose high design constraints on radio frequency antennas to be used in hearing aids with wireless communication capabilities.

Moreover, the antenna in the hearing aid has to be designed to achieve a satisfactory performance despite these limitations and other high design constraints imposed by the size of the hearing aid.

Still further, in binaural hearing aid systems, the requirements to the quality of the communication between the hearing aids in the binaural hearing aid system are ever increasing, and include demands for low latency and low noise, increasing the requests for effective antennas in the hearing aids.

SUMMARY

There is a need for improved wireless communication in hearing aids.

It is an object to provide a hearing aid with improved wireless communication capabilities, such as improved wireless communication capabilities between two hearing aids worn in opposite ears of the user, and/or between a hearing aid and an accessory device.

Radio connectivity between hearing aids (His) allows for advanced binaural signal processing when the important ear-to-ear (E2E) link is ensured. Furthermore, the Hs may be connected to a plethora of accessories, that can be either body-worn or placed in the user's proximity, and hence to the internet as part of the so-called internet of things (IoT). However, it is challenging but of key importance to ensure a stable E2E link. The 2.4 GHz ISM band is preferred due to the presence of many harmonized standards for low-power communications, such as BLE or ZigBee, its worldwide availability for industrial use, and the trade-off between power consumption and range that can be achieved. The E2E link is particularly demanding in terms of requirements on the wearable antenna design and performance. In fact, in order to achieve a good on-body performance, the antenna needs to exhibit optimal radiation efficiency, bandwidth, polarization, and radiation pattern, while the volume available for the design is extremely reduced, as most times space comes at a premium in wearable devices such as in hearing aid, in particular in ITE hearing aids. Furthermore, mass production and industrial design needs demand the antenna to be as well low-profile, lightweight, and inexpensive to manufacture. In particular, the antenna polarization characteristic is an important performance parameter. More overall constrains may also be relevant. In fact, the efficiency may be seriously jeopardized by the proximity of the antenna to the human head, as the body tissues have very high losses around 2.4 GHz due to the high water content. This may critically impact the overall performance given the magnitude of the drop in efficiency and the fact that the HI radios operate in ultra-low-power regime. Another issue threatening antenna efficiency is the little volume available for the design, as this necessarily brings the antenna in close physical, hence, electrical as well, proximity of other parts of the device, with a strong likelihood of coupling to them. A large bandwidth is as well hard to achieve for an electrically small antenna (ESA), due to its fundamental limits. The bandwidth may cover at least the whole 2.4 GHz ISM band, but a larger bandwidth would help to compensate for the detuning of the antenna caused by the body, that varies across users.

In accordance with the present disclosure, the above-mentioned and other objects are obtained by an in-the-ear hearing aid. The hearing aid has a first end and a second end. The hearing aid comprises a microphone configured to receive sound. The hearing aid comprises a processing unit configured to provide a processed audio signal for compensating a hearing loss of a user. The hearing aid comprises an output transducer for providing an acoustic output. The hearing aid comprises an antenna and a wireless communication unit for wireless communication. The antenna is provided closer to the first end than to the second end of the hearing aid. The hearing aid comprises a polarization element configured for forming the polarization of the antenna. The polarization element is provided between the first end and the second end of the hearing aid.

According to a further aspect, a binaural hearing aid system is disclosed comprising a first and a second hearing aid as herein disclosed. Thus the first and/or second hearing aid may be a hearing aid as disclosed above.

Thus it is an advantage that the polarization of the antenna can be formed or controlled or directed, for example such that it is higher in an orthogonal direction or normal to the head of the user or to the surface of the head of the user. The polarization should be formed such that it improves the wireless communication between for example two hearing aids arranged in both ears of the user. The correct polarization of the antenna, e.g. a polarization which is higher in an orthogonal direction to the surface of the head of the user, is an advantage as this is optimal to excite a strong surface wave, i.e. electromagnetic wave, along the body, such as along the face of the user, such as to the other ear of the user.

The wireless communication between two hearing aids is an advantage as the hearing aids can communicate together, and such that each hearing aid does not need to be adjusted manually, but can be adjusted automatically due to the wireless communication with the hearing aid in the other ear.

For example if the user turns his head, for example when he is in a conversation with another person, the ear pointing away from the sound source, e.g. the conversation partner, will receive less sound, and this ear will thus hear less. Normally the user will then turn up the volume of this hearing aid. However with the ear-to-ear technology the two hearing aids communicate wirelessly with each other and can automatically turn up and down the volume when needed.

The correct or optimal polarization of the antenna provided by the polarization element in the hearing aid(s) thus improves this wireless ear-to-ear communication between the hearing aids.

The polarization of the antenna corresponds or defines or determines the direction of the electric field or E-field.

The antenna is for emission and/or reception of an electromagnetic field being interconnected with one of the one or more wireless communication units.

The antenna may be an electric antenna. The antenna may be a monopole antenna.

The antenna may be a dipole antenna. The antenna may be a resonant antenna. The antenna may be a quarter-wave monopole antenna etc.

Thus it is an advantage that the antenna may be short, such as shorter than a loop antenna. When the antenna is short, the antenna does not require much space in the hearing aid and thus there are more options and flexibility with regards to the arrangement of the antenna and the relative arrangement of first antenna and the other components.

The antenna may be configured to have a first radiation pattern.

The near field pattern for the antenna may be a TM polarized near field. The first radiation pattern may be dominated by the E-field, so that a primary part of the overall electromagnetic field, such as more than 75%, such as more than 80%, such as more than 85%, such as more than 90% of the overall electromagnetic field, is contributed by the E-field.

The antenna may be a 2.4 GHz antenna. The antenna may be configured for radiation in a first frequency range. A second antenna may be provided, e.g. a magnetic antenna, and the second antenna may be configured for radiation in a second frequency range.

The antenna may be configured to operate in the first frequency range, such as at a frequency above 800 MHz, such as at a frequency above 1 GHz, such as at a frequency of 2.4 GHz, such as at a frequency between 1.5 GHz and 3 GHz, during use. Thus, the antenna may be configured for operation in ISM frequency band. The antenna may be any antenna capable of operating at these frequencies, and the antenna may thus be a resonant antenna, such as monopole antenna, such as a dipole antenna, etc. The resonant antenna may have a length of lambda/4 or any multiple thereof, lambda being the wavelength corresponding to the emitted electromagnetic field.

In present day communication systems, numerous different communication systems communicate at or about 2.4 GHz, and thus there is also a significant noise in the frequency range at or about 2.4 GHz. It is an advantage that for some applications for which the noise may be acceptable, for example for data communication, the antenna, such as an electrical antenna may be used. For other applications, in which a high noise level may impact the transmission significantly, a second antenna, such as a magnetic antenna may be used. For example, the second antenna may be used for streaming of audio.

The antenna may be configured for data communication at a first bit rate. In one or more embodiments, a second antenna may be provided and the second antenna may be configured for data communication at a second bit rate, the second bit rate being larger than the first bit rate, such as by a factor 10, such as by a factor 30, a factor 50, a factor 100, etc.

The hearing aid has the antenna at the first end of the hearing aid device. The hearing aid may comprise a shell, such as an in-the-ear (ITE) shell. To improve the polarization of the antenna a polarization element is provided, for example a layer of conducting material is placed on the shell of the device. Alternatively the shell can be made of a conducting material. It is desirable to have the outside of the shell made of plastic as it is normally done. The inside of the shell can then be covered by the conducting material.

This means that there will be at least some currents induced on the polarization element, such as on the conducting material on the shell, and these currents have a direction between the first end and the second end of the hearing aid device. This is an improvement compared to just having the antenna by itself, because the antenna by itself is placed in a plane, which has an orientation that means that the electric field transmitted by the antenna for the most part will be in the skin of the user, such as parallel to the surface of the user's head.

However, with a polarization element forming the polarization of the antenna, such as a shell made out of conducting material, the electric field can be oriented or directed or turned so that it becomes more orthogonal to the surface, and thus skin, of the user's head. This is advantageous, because skin has many charges which will attenuate the electric field if it is oscillating in the surface skin of the user as it travels along the body and face.

The diameter at the first end of the hearing aid is typically 1 cm to 3 cm. The distance between the first end and the second of the hearing aid is typically also 1 cm to 3 cm.

An opening for a microphone port is typically placed at the first end. An opening for an output transducer port or receiver output port is typically placed at the second end.

A printed circuit board may be provided in the hearing aid. The antenna may be connected to the circuit board with a wire. The circuit board may have a matching circuit, a balun and a radio, such as a wireless communication unit.

The polarization element, such as the conducting material, can be connected to ground or it can be floating, i.e. not connected to ground.

The first end of the hearing aid may point towards the surroundings when the hearing aid is arranged in the ear of the user during use.

The second end of the hearing aid may point towards the inner ear or towards the head of the user when the hearing aid is arranged in the ear of the user during use.

The hearing aid may comprise a battery. The battery may have a first side and a second side. The battery may be provided at the first end of the hearing aid.

The battery may be a flat battery, such as a button shaped battery. The battery may be circular. The battery may be a disk-shaped battery.

The hearing aid may be any hearing aid, such as a hearing aid of the in-the-ear type, such as in-the-canal type, such as completely-in-the-canal type of hearing aid, etc., a hearing aid of the behind-the-ear type, of the receiver-in-the-ear type of hearing aid, etc.

One or more wireless communications unit(s) are configured for wireless data communication, and in this respect interconnected with the antenna for emission and reception of an electromagnetic field. Each of the one or more wireless communication units may comprise a transmitter, a receiver, a transmitter-receiver pair, such as a transceiver, a radio unit, etc. The one or more wireless communication units may be configured for communication using any protocol as known for a person skilled in the art, including Bluetooth, WLAN standards, manufacture specific protocols, such as tailored proximity antenna protocols, such as proprietary protocols, such as low-power wireless communication protocols, RF communication protocols, magnetic induction protocols, etc. The one or more wireless communication units may be configured for communication using same communication protocols, or same type of communication protocols, or the one or more wireless communication units may be configured for communication using different communication protocols.

The processing unit may be provided on a printed circuit board.

The printed circuit board may be is provided at the first end of the hearing aid. Thus it is an advantage that the printed circuit board and the output transducer or receiver are arranged in opposite ends of the hearing aid for reducing the risk of electromagnetic interference between these two.

The hearing aid may have a hearing aid shell having a first and a second end, where the first end of the hearing aid shell is at the first end of the hearing aid, and where the second end of the hearing aid shell is at the second end of the hearing aid. Thus the first end of the hearing aid shell may be provided, or arranged at, or placed at the first end of the hearing aid. Thus the first end of the hearing aid shell corresponds to the first end of the hearing aid. Thus the second end of the hearing aid shell may be provided, or arranged at, or placed at the second end of the hearing aid. Thus the second end of the hearing aid shell corresponds to the second end of the hearing aid. All components of the hearing aid may be arranged in the hearing aid shell.

The term sound and/or the term acoustic output may be understood to be an audio signal. Thus the microphone may be configured to receive sound or an audio signal. The output transducer may be configured to provide or transmit an acoustic output or a processed audio signal, such as the processed audio signal provided by the processing unit. The acoustic output or processed audio signal may be provided or transmitted to an ear of the user wearing the hearing aid during use.

In some embodiments the polarization of the antenna is higher in an orthogonal direction to a surface of the user's head than in a direction parallel to the surface of the user's head, when the hearing aid is arranged in an ear of the user during use of the hearing aid.

Thus it is an advantage that the polarization of the antenna is higher in an orthogonal direction or normal to the head of the user or to the surface of the head of the user as this improves the wireless communication between for example two hearing aids arranged in both ears of the user. The orthogonal polarization of the antenna is an advantage as this is optimal to excite a strong surface wave, i.e. electromagnetic wave, along the body, such as along the face of the user, such as to the other ear of the user.

Thus the polarization of the antenna is primarily, mainly or substantially orthogonal or normal to the surface of the user's head. The polarization of the antenna is orthogonal to the surface of the head such as 10 degrees from orthogonal, such as 15 degrees orthogonal, such as 20 degrees orthogonal, such as 25 degrees orthogonal, such as 30 degrees orthogonal etc.

In some embodiments the polarization element comprises an electrically conducting material. Thus it is an advantage that the polarization element may be provided as an electrically conducting material. The electrically conducting material may be an electrically conducting metal, such as cobber, and/or another suitable material which is electrically conducting and can form the polarization of the antenna. The electrically conducting material may be in the form of a metallic sheet or surface.

In some embodiments the polarization element extends from the first end of the hearing aid. For example the polarization element extends in a direction from the first end.

In some embodiments the polarization element extends to the second end of the hearing aid. For example the polarization element extends in a direction to the second end.

In some embodiments the polarization elements extends from the first end to the second end of the hearing aid.

In some embodiments the hearing aid comprises a hearing aid shell, and wherein the microphone, the processing unit, the output transducer, the antenna, the wireless communication unit, and the polarization element are provided in the hearing aid shell.

In some embodiments the hearing aid shell comprises an inner surface having an area, and wherein the polarization element covers more than 50% of the area of the inner surface of the hearing aid shell.

The polarization element, such as the conducting material, may be provided on the inner surface of the hearing aid shell. The polarization element, such as the conducting material may cover more than 50% of the area of the inner surface, such as more than 60%, such as more than 70%, such as more than 80%, such as more than 90%. Alternatively the whole inner surface area of the shell, i.e. 100%, may be covered by the polarization element.

In some embodiments a layer of the polarization element is placed on the hearing aid shell. The polarization element may be placed on the inner surface of the hearing aid shell. The polarization element may be placed on the outer surface of the hearing aid shell. The polarization element may be placed in the inside of the hearing aid shell, such as on an inside layer of the hearing aid shell.

In some embodiments the polarization element is shaped as a strip having a width and a length, and wherein the length of the strip corresponds to a distance along the inner surface of the hearing aid shell from the first end to the second end of the hearing aid shell.

The strip may be arranged in a direction from the first end to the second end, such that the length of the strip corresponds to a distance along the inner surface of the shell. The strip may be arranged from the outermost point in the first end. The strip may be arranged to the outermost point in the second end. The strip may be arranged halfway between the first end and the second end of the hearing aid. The strip may be placed anywhere between the first end and the second end, such as in the first end and/or in the second end.

The length of the strip may be larger than the width of the strip. The ratio between the length and the width of the strip may be 1:1, 1.5:1, 2:1, 2.5:1, 3:1, 3.5:1, 4:1, 4.5:1, 5:1 etc. The length of the strip may be smaller than the width of the strip. The ratio between the length and the width of the strip may be 1:5, 1:4.5, 1:4, 1:3.5, 1:3, 1:2.5, 1:2, 1:1.5 etc. For example the strip may be 3 cm long and 1 cm wide, or 3 cm long and 2 cm wide, or 2 cm long and 2 cm wide, or 1 cm long and 2 wide, or 1 cm long and 3 cm wide etc.

The strip may be oblong. The strip may be rectangular, such as quadratic. The strip may be triangular or trilateral.

The strip may be pentagonal. The strip may be polygonal. The strip may be circular. The strip may be oval.

One or more strips may be provided, such as two strips, three strips, four strips or five strips.

In some embodiments the antenna comprises a first end and a second end, and wherein the first end of the antenna is connected to the polarization element.

Alternatively, the antenna is not connected to the polarization element. Alternatively and/or additionally the second end of the antenna is connected to the polarization element. For example both the first end of the antenna and the second end of the antenna is connected to the polarization element.

In some embodiments the first end of the hearing aid is pointing towards the surroundings when a user is wearing the hearing aid during use, and where the second end of the hearing aid is pointing towards the inner ear of the user during use. The first end of the hearing aid may extend over or cover a third of the distance between an outermost point of the first end and an outermost point of the second end.

Alternatively the first end of the hearing aid may extend over or cover a half, or a fourth, or a fifth, or a sixth, or a seventh, or an eight, or a ninth, or a tenth of the distance between the outermost point of the first end and the outermost point of the second end of the hearing aid.

The second end may extend over or cover a third of the distance between the outermost point of the second end and the outermost point of the first end.

Alternatively the second end of the hearing aid may extend over or cover a half, or a fourth, or a fifth, or a sixth, or a seventh, or an eight, or a ninth, or a tenth of the distance between the outermost point of the second end and the outermost point of the first end of the hearing aid.

The antenna is arranged in the first end of the hearing aid. The antenna may be arranged in the outer third part of the first end, or in the outer half part of the first end, or in the outer fourth part of the first end, or in the outer fifth part of the first end, or in the outer sixth part of the first end, or in the outer seventh part of the first end, or in the outer eight part of the first end, or in the outer ninth part of the first end, or in the outer tenth part of et first end etc.

An outermost point of the first end and an outermost point of the second end may be the two points or areas in the first end and the second end, respectively, of the hearing aid or of the hearing aid shell which have the longest distance to each other, such as the longest distance along the inner surface of the shell or the longest direct distance in air from point to point.

In some embodiments the hearing aid shell comprises an opening in the first end of the hearing aid shell, and wherein the hearing aid shell comprises a cover for closing the opening of the hearing aid shell. The cover may be a faceplate or the cover may comprise a faceplate. The cover may comprise a battery door.

The hearing aid typically comprises a shell, such as a polymer or plastic shell, in a shape configured to be provided in the ear, in the ear-canal or completely-in-the-canal of the ear of a user. The shell of an in-the-ear having aid may comprise a first end at the first end of the hearing aid and a second end at the second end of the hearing aid. The shell may comprise a faceplate in the first end of the shell. The faceplate is a plate or cover closing the first end of the hearing aid shell. The hearing aid shell may be open in the first end and thus the faceplate provides a closing of the hearing aid shell. The faceplate may comprise one or components of the hearing aid. The faceplate may comprise a battery door. The faceplate may be detachable or removable from the hearing aid shell, e.g. for the purpose of changing the battery and/or replacing or repairing other components in the hearing aid shell.

In some embodiments the antenna is comprised in the cover. In some embodiments the antenna is attached in the cover, for example attached to the faceplate.

In some embodiments the antenna has a longitudinal extension in a first direction.

In some embodiments the first direction of the longitudinal extension of the antenna is in a plane parallel to the opening of the hearing aid shell.

The antenna may have a longitudinal extension in a first direction. Thus, the antenna may have an overall longitudinal extension in a first direction. The direction may indicate a line or path along which the antenna is extending. For example, the overall length of the antenna may be larger than the overall width of the antenna indicating a longitudinal extension in the lengthwise direction.

Thus, for example, the antenna may comprise a first antenna element extending along a plane parallel to the faceplate and to the first end of the hearing aid. The first antenna element may extend along a plane normal to a first axis. The first axis may extend from the first end of the hearing aid to the second end of the hearing aid.

It is an advantage that due to the polarization element, the polarization of the antenna can be formed to be higher in an orthogonal direction to a surface of the user's head than in a direction parallel to the surface of the user's head, when the hearing aid is arranged in an ear of the user during use of the hearing aid. This improves the wireless ear-to-ear communication between the ears of the user. If no polarization element is provided in the hearing aid, the polarization of the antenna would be mainly in a direction parallel to the surface of the user's head, when the direction of the longitudinal extension of the antenna is in a plane parallel to the opening of the hearing aid shell, when the hearing aid is arranged in the ear of the user during use, and this would not improve the wireless ear-to-ear communication between the ears of the user.

In some embodiments the hearing aid comprises a printed circuit board, where the printed circuit board comprises a ground plane.

The hearing aid may comprise hearing aid electronic components including the processing unit or signal processor. The hearing aid electronic components may be provided on a printed circuit board. The one or more wireless communication units or radios may be arranged on the printed circuit board The printed circuit board may be arranged between the first end and the second end of the hearing aid. The printed circuit board may be arranged in the first end of the hearing aid. The printed circuit board may be arranged in the second end of the hearing aid.

Typically there is no ground plane in a hearing aid, as a ground plane may be a conducting plane of infinite area or an area which is at least five wavelengths wide and five wavelengths long. However, a layer of the printed circuit board may work as or have the function of a ground plane. Thus the ground plane for the antenna, such as a monopole antenna, may be whatever structure that the ground connection from the balun is connected to.

In some embodiments the antenna is connected to the ground plane of the circuit board.

In some embodiments the polarization element is connected to the ground plane of the circuit board.

Thus the polarization element, for example a metallic surface of the shell, can be connected to ground instead of just being floating, i.e. with no galvanic connection to anything else.

As the shell is meant to fit in the ear, it has to be modelled according to each user's unique ear canal shape. In the hearing industry, this is typically done by taking an impression of the ear. The shell may then be built on a 3D-printed plastic substrate to fit the custom shape of the user's ear. For providing the polarization element in the hearing aid, the support may be realized with a Selective Heat Synthering (SHS) process that may exhibit a dielectric constant $\varepsilon_r$=2.4 and a loss tangent tan $\delta$=0.0012 at the frequency of interest. The polarization element, such as conductive layers, may be implemented with a conducting metal, solid copper. Furthermore the ground plane and/or at least a part of the antenna may be implemented with a conducting metal, such as solid cobber.

An advantage of the hearing aid(s) as disclosed herein is that an improved wireless ear-to-ear communication may be achieved for most head sizes, shapes and amount of hair. Human heads and human ears vary in size and shape and also the amount of hair varies from person to person. Hearing aids adapted for wireless communications may be susceptible to impairments of for example the ear-to-ear communication due to e.g. the head of the user. Radio waves from a hearing aid at one side may have to travel through or around the head in order to reach the hearing aid at the other ear. Therefore, the human head may be perceived as an obstacle to the ear-to-ear communication. It is an advantage that the polarization of the antenna as provided in the hearing aid improves the ear-to-ear communication.

In the following, various features are described primarily with reference to a hearing aid, such as a binaural hearing aid. It is however envisaged that the disclosed features and embodiments may be applied for other types of hearing devices, and may be applied in combination.

The present disclosure relates to different aspects including the hearing aid described above and in the following, and corresponding methods, devices, systems, uses and/or product means, each yielding one or more of the benefits and advantages described in connection with the first mentioned aspect, and each having one or more embodiments corresponding to the embodiments described in connection with the first mentioned aspect and/or disclosed in the appended claims.

An in-the-ear hearing aid, the hearing aid having a first end and a second end, the hearing aid includes: a microphone configured to receive sound; a processing unit configured to provide a processed audio signal for compensating a hearing loss of a user; an output transducer for providing an acoustic output, wherein the microphone and the output transducer are coupled to the processing unit; an antenna that is closer to the first end than to the second end of the hearing aid; a wireless communication unit coupled to the antenna; and a polarization element configured for forming a polarization of the antenna, where the polarization element is between the first end and the second end of the hearing aid.

Optionally, the polarization of the antenna is higher in an orthogonal direction to a surface of a head of the user than in a direction parallel to the surface of the head of the user, when the hearing aid is arranged in an ear of the user during use of the hearing aid.

Optionally, the polarization element comprises an electrically conducting material.

Optionally, the polarization element extends from the first end of the hearing aid, and/or wherein the polarization element extends to the second end of the hearing aid.

Optionally, the hearing aid further includes a hearing aid shell, wherein the microphone, the processing unit, the output transducer, the antenna, the wireless communication unit, and the polarization element are in the hearing aid shell.

Optionally, the hearing aid shell comprises an inner surface having an area, and wherein the polarization element covers more than 50% of the area of the inner surface of the hearing aid shell.

Optionally, a layer of the polarization element is on the hearing aid shell.

Optionally, the polarization element is shaped as a strip having a width and a length, and wherein the length of the strip corresponds to a distance along an inner surface of the hearing aid shell from a first end of the hearing aid shell to a second end of the hearing aid shell.

Optionally, the antenna comprises a first antenna end and a second antenna end, and wherein the first antenna end of the antenna is connected to the polarization element.

Optionally, the first end of the hearing aid is configured to point towards a surrounding when the user is wearing the hearing aid, and wherein the second end of the hearing aid is configured to point towards an inner ear of the user when the user is wearing the hearing aid, wherein the first end extends over a third of a distance between an outermost point of the first end and an outermost point of the second end.

Optionally, the hearing aid shell comprises an opening at a first end of the hearing aid shell, the hearing aid shell comprises a cover for closing the opening of the hearing aid shell, and the antenna is comprised in or attached to the cover.

Optionally, the antenna has a longitudinal extension in a first direction, and wherein the first direction of the longitudinal extension of the antenna is in a plane parallel to the opening of the hearing aid shell.

Optionally, the hearing aid further includes a printed circuit board, wherein the printed circuit board comprises a ground plane, and wherein the antenna and/or the polarization element is coupled to the printed circuit board.

Optionally, the antenna is connected to the ground plane of the circuit board.

Optionally, the polarization element is connected to the ground plane of the circuit board.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
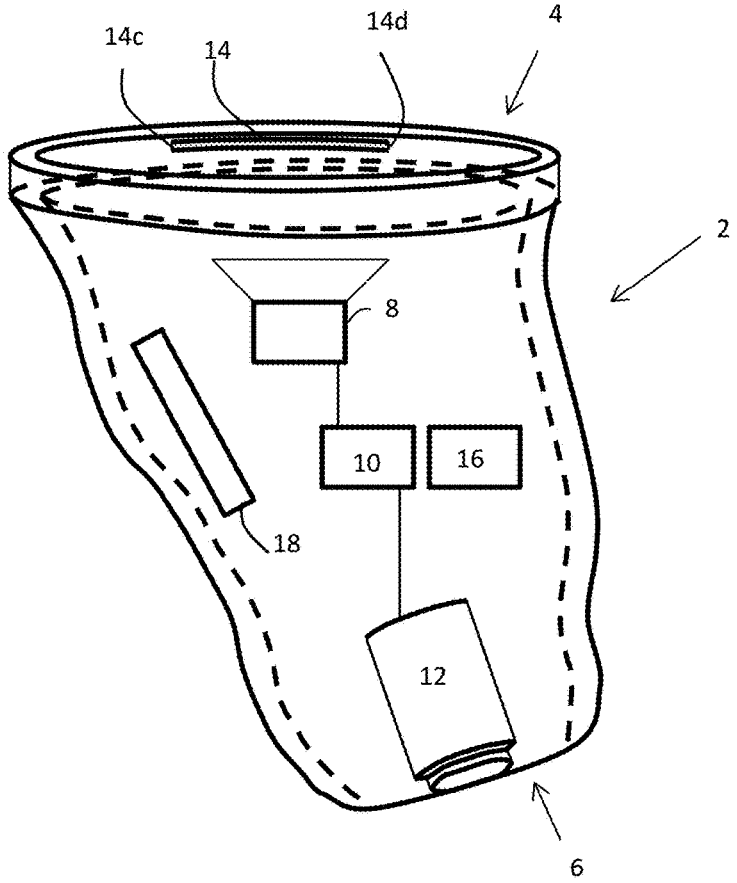
FIG. 1 schematically illustrates an example of an in-the-ear hearing aid.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Throughout, the same reference numerals are used for identical or corresponding parts.

As used herein, the term "antenna" refers to an electrical or magnetic device which converts electric or magnetic power into radio waves. An electric antenna may comprise an electrically conductive material connected to e.g. a wireless communications unit, such as a radio chip, a receiver or a transmitter. A magnetic antenna, such as a magnetic loop antenna, may comprise a coil of electrically conductive material wound around a core of magnetic material.

FIG. 1 schematically illustrates an example of an in-the-ear hearing aid 2. The hearing aid 2 has a first end 4 and a second end 6. The hearing aid 2 comprises a microphone 8 configured to receive sound. The hearing aid 2 comprises a processing unit 10 configured to provide a processed audio signal for compensating a hearing loss of a user. The hearing aid 2 comprises an output transducer 12 for providing an acoustic output. The hearing aid 2 comprises an antenna 14 and a wireless communication unit 16 for wireless communication. The wireless communication unit 16 is coupled to the antenna 14. In some cases, the wireless communication unit 16 is also coupled to the processing unit 10. The antenna 14 is provided closer to the first end 4 than to the second end 6 of the hearing aid 2. The hearing aid 2 comprises a polarization element 18 configured for forming the polarization of the antenna 14. The polarization element 18 is provided between the first end 4 and the second end 6 of the hearing aid 2. The polarization element 18 is shown as a block in this figure, but could also be provided as a metallic layer in the shell, as one or more strips etc. Thus the polarization element 18 may comprise an electrically conducting material. The polarization element 18 may extend from the first end 4 of the hearing aid 2 and/or extend to the second end 6 of the hearing aid 2.

The polarization of the antenna may be higher in an orthogonal direction to a surface of the user's head than in a direction parallel to the surface of the user's head, when the hearing aid is arranged in an ear of the user during use of the hearing aid.

The hearing aid 2 may comprise a hearing aid shell, and the microphone 8, the processing unit 10, the output transducer 12, the antenna 14, the wireless communication unit 16, and the polarization element 18 may be provided in the hearing aid shell.

The hearing aid shell may comprise an inner surface having an area, and the polarization element 18 may covers more than 50% of the area of the inner surface of the hearing aid shell.

A layer of the polarization element 18 may be placed on the hearing aid shell.

The polarization element 18 may be shaped as a strip having a width and a length, and wherein the length of the strip corresponds to a distance along the inner surface of the hearing aid shell from the first end 4 to the second end 6 of the hearing aid shell.

The antenna may comprise a first end 14*c* and a second end 14*d*, and the first end 14*c* of the antenna 14 may be connected to the polarization element 18.

The first end 4 of the hearing aid 2 is pointing towards the surroundings when a user is wearing the hearing aid 2 during use, and the second end 6 of the hearing aid 2 is pointing towards the inner ear of the user during use.

The first end 4 of the hearing aid 2 may extend over or be defined as a third of the distance between an outermost point of the first end 4 and an outermost point of the second end 6.

The hearing aid shell may comprise an opening in the first end 4 of the hearing aid shell, and the hearing aid shell may comprise a cover for closing the opening of the hearing aid shell.

The antenna 14 may be comprised in or attached to the cover.

The antenna 14 may have a longitudinal extension in a first direction. The first direction of the longitudinal extension of the antenna 14 may be in a plane parallel to the opening of the hearing aid shell.

The hearing aid 2 may comprise a printed circuit board, and the printed circuit board may comprise a ground plane. The antenna 14 may be connected to the ground plane of the printed circuit board. The polarization element 18 may be connected to the ground plane of the printed circuit board.

Figure 2:
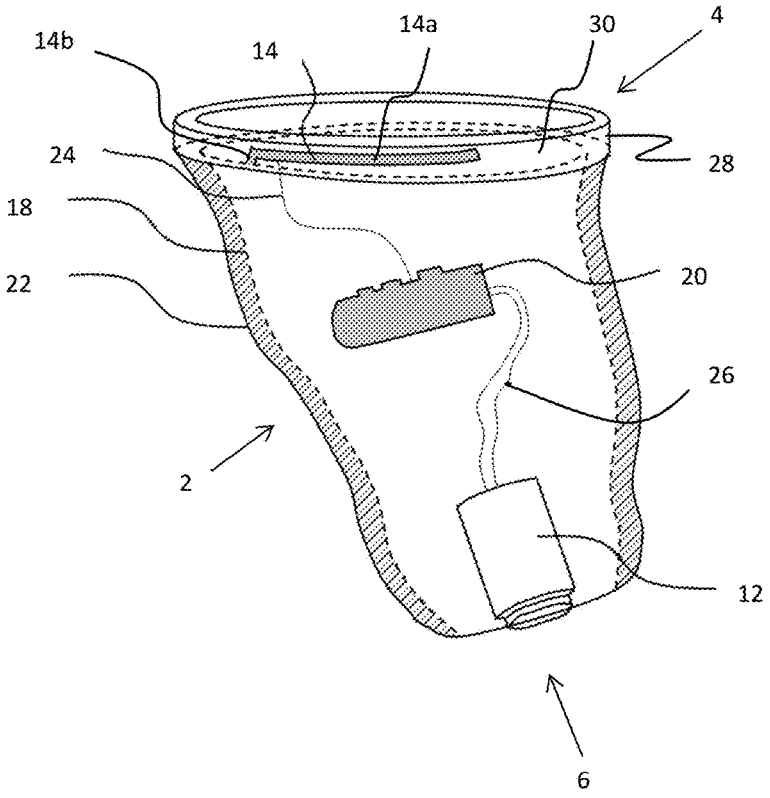
FIG. 2 schematically illustrates an example of an in-the-ear hearing aid.

FIG. 2 schematically illustrates an example of an in-the-ear hearing aid 2. The hearing aid 2 has a first end 4 and a second end 6. The hearing aid 2 comprises a microphone (not shown) configured to receive sound. The hearing aid 2 comprises a printed circuit board 20 which may comprise a processing unit (not shown) configured to provide a processed audio signal for compensating a hearing loss of a user. The hearing aid 2 comprises an output transducer 12 for providing an acoustic output. The hearing aid 2 comprises an antenna 14. The antenna 14 is provided at the first end 4 of the hearing aid 2. A cover 28 or faceplate is provided on the opening 30 of the hearing aid in the first end 4. The antenna 14 may be arranged in the cover 28 or faceplate. The antenna 14 comprises a first antenna element 14*a* which extends in a longitudinal direction parallel to the opening 30 and the cover 28. The antenna 14 comprises a second antenna element 14*b* perpendicular to the first antenna element 14*a*. The hearing aid 2 comprises a polarization element 18 configured for forming the polarization of the antenna 14. The polarization element 18 is provided between the first end 4 and the second end 6 of the hearing aid 2. The polarization element 18 is provided as a metallic layer in the shell 22 of the hearing aid.

A wireless communication unit (not shown) for wireless communication may be arranged on the printed circuit board 20. A transmission line 24 is provided between the antenna 14 and the printed circuit board 20, thus the antenna is connected to the ground plane of the printed circuit board 20 and thus grounded. The circuit board 20 is connected 26 to the output transducer 12.

Figure 3:
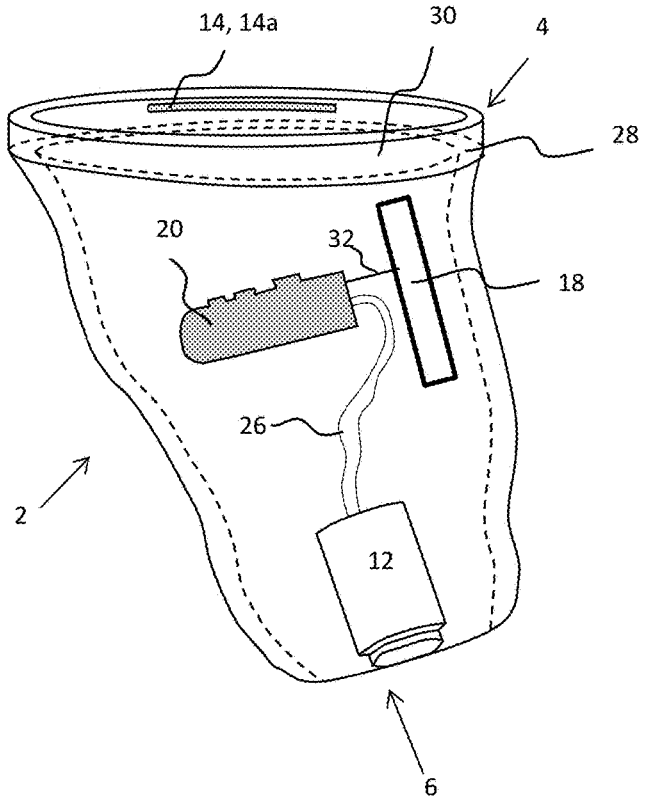
FIG. 3 schematically illustrates an example of an in-the-ear hearing aid.

FIG. 3 schematically illustrates an example of an in-the-ear hearing aid 2. The hearing aid 2 has a first end 4 and a second end 6. The hearing aid 2 comprises a microphone (not shown) configured to receive sound. The hearing aid 2 comprises a printed circuit board 20 which may comprise a processing unit (not shown) configured to provide a processed audio signal for compensating a hearing loss of a user. The hearing aid 2 comprises an output transducer 12 for providing an acoustic output. The hearing aid 2 comprises an antenna 14. The antenna 14 is provided at the first end 4 of the hearing aid 2. The antenna 14 in FIG. 3 is provided closer to the outermost point or plane of the first end 4 than in FIG. 2. A cover 28 or faceplate is provided on the opening 30 of the hearing aid in the first end 4. The antenna 14 may be arranged in the cover 28 or faceplate. The antenna 14 comprises a first antenna element 14*a* which extends in a longitudinal direction parallel to the opening 30 and the cover 28. The hearing aid 2 comprises a polarization element 18 configured for forming the polarization of the antenna 14. The polarization element 18 is provided between the first end 4 and the second end 6 of the hearing aid 2. The polarization element 18 is shown as a block in this figure. The polarization element 18 is connected 32 to a ground plane of the printed circuit board 20.

A wireless communication unit (not shown) for wireless communication may be arranged on the printed circuit board 20. No transmission line is provided between the antenna 14 and the printed circuit board 20, thus the antenna is not connected to the ground plane of the printed circuit board 20 and thus not grounded. The circuit board 20 is connected 26 to the output transducer 12.

Figure 4:
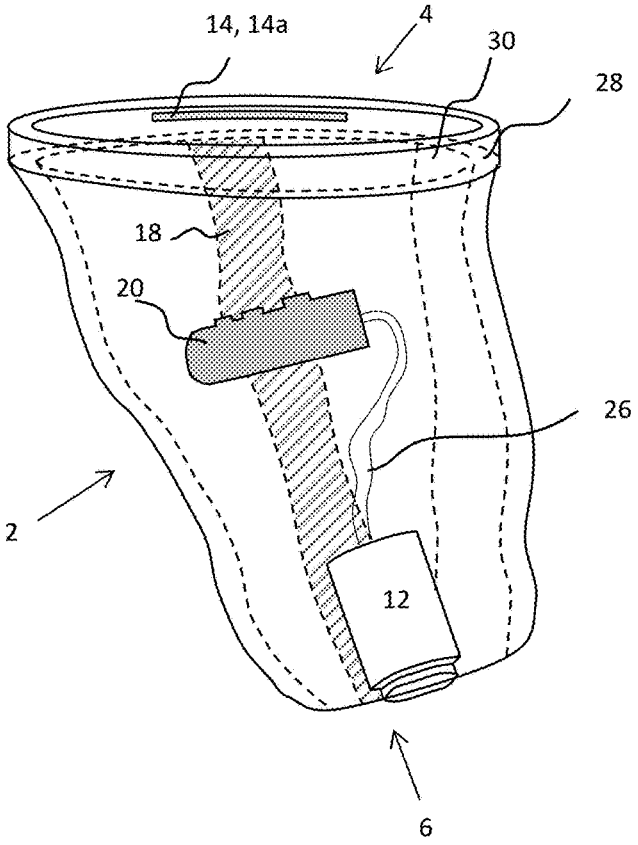
FIG. 4 schematically illustrates an example of an in-the-ear hearing aid.

FIG. 4 schematically illustrates an example of an in-the-ear hearing aid 2. The hearing aid 2 has a first end 4 and a second end 6. The hearing aid 2 comprises a microphone (not shown) configured to receive sound. The hearing aid 2 comprises a printed circuit board 20 which may comprise a processing unit (not shown) configured to provide a processed audio signal for compensating a hearing loss of a user. The hearing aid 2 comprises an output transducer 12 for providing an acoustic output. The hearing aid 2 comprises an antenna 14. The antenna 14 is provided at the first end 4 of the hearing aid 2. The antenna 14 in FIG. 4 is provided closer to the outermost point or plane of the first end 4 than in FIG. 2. A cover 28 or faceplate is provided on the opening 30 of the hearing aid in the first end 4. The antenna 14 may be arranged in the cover 28 or faceplate. The antenna 14 comprises a first antenna element 14*a* which extends in a longitudinal direction parallel to the opening 30 and the cover 28. The hearing aid 2 comprises a polarization element 18 configured for forming the polarization of the antenna 14. The polarization element 18 is provided between the first end 4 and the second end 6 of the hearing aid 2. The polarization element 18 is provided as a strip extending from the first end 4 to the second end 6. The strip has a length and a width, where the length corresponds to a distance along the inner surface of the hearing aid shell from the first end 4 to the second end 6. The width of the strip is smaller than the length of the strip in this figure.

A wireless communication unit (not shown) for wireless communication may be arranged on the printed circuit board 20. No transmission line is provided between the antenna 14 and the printed circuit board 20, thus the antenna is not connected to the ground plane of the printed circuit board 20 and thus not grounded. The circuit board 20 is connected 26 to the output transducer 12.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

LIST OF REFERENCES

2 hearing aid
4 first end of hearing aid
6 second end of hearing aid
8 microphone
10 processing unit
12 output transducer
14 antenna
14*a* first antenna element
14*b* second antenna element
14*c* first end of antenna
14*d* second end of antenna
16 wireless communication unit
18 polarization element 18
20 printed circuit board
22 shell
24 transmission line
26 connection between printed circuit board and output transducer
28 cover or faceplate
30 opening of the hearing aid
32 connection of polarization element to ground plane

The invention claimed is:

1. A hearing aid, the hearing aid having a hearing aid shell, the hearing aid shell having a first end and a second end that is opposite from the first end, the hearing aid comprising:

a microphone configured to receive sound;

a processing unit configured to provide a processed audio signal for compensating a hearing loss of a user;

an output transducer for providing an acoustic output, wherein the microphone and the output transducer are coupled to the processing unit;

an antenna, wherein the hearing aid shell comprises an opening at the first end of the hearing aid shell, the hearing aid shell comprises a cover for closing the opening of the hearing aid shell, wherein the antenna is located closer to the first end of the hearing aid shell than to the second end of the hearing aid shell;

a wireless communication unit coupled to the antenna;

a polarization element configured for forming a polarization of the antenna, wherein the polarization element is between the first end and the second end of the hearing aid shell;

wherein the microphone, the processing unit, the output transducer, the antenna, the wireless communication unit, and the polarization element are in the hearing aid shell;

wherein the first end of the hearing aid shell and the second end of the hearing aid shell define a longitudinal axis of the hearing aid shell, the longitudinal axis of the hearing aid shell corresponding with an ear-to-ear axis of the user when the hearing aid is worn by the user;

wherein at least a part of the polarization element extends in a direction having a primary directional component that corresponds with the ear-to-ear axis of the user when the hearing aid is worn by the user; and wherein the polarization of the antenna is higher in an orthogonal direction to a surface of a head of the user than in a direction parallel to the surface of the head of the user, when the hearing aid is arranged in an ear of the user during use of the hearing aid.

2. The hearing aid according to claim 1, wherein the polarization element comprises an electrically conducting material.

3. The hearing aid according to claim 1, wherein the hearing aid shell comprises a total inner surface area, and wherein the polarization element covers more than 50% of the total inner surface area of the hearing aid shell.

4. The hearing aid according to claim 1, wherein a layer of the polarization element is on an interior surface of the hearing aid shell.

5. The hearing aid according to claim 1, wherein the polarization element is shaped as a strip having a width and a length, and wherein the length of the strip corresponds to a distance along an inner surface of the hearing aid shell from the first end of the hearing aid shell to the second end of the hearing aid shell.

6. The hearing aid according to claim 1, wherein the antenna comprises a first antenna end and a second antenna end, and wherein a first antenna end of the antenna is connected to the polarization element.

7. The hearing aid according to claim 1, wherein the first end of the hearing aid shell is configured to point towards a surrounding when the user is wearing the hearing aid, and wherein the second end of the hearing aid shell is configured to point towards an inner ear of the user when the user is wearing the hearing aid, wherein the first end extends over a third of a distance between an outermost point of the first end and an outermost point of the second end.

8. The hearing aid according to claim 1, wherein the antenna is comprised in or attached to the cover.

9. The hearing aid according to claim 1, wherein the antenna has a longitudinal extension in a first direction, and wherein the first direction of the longitudinal extension of the antenna is in a plane parallel to the opening of the hearing aid shell.

10. The hearing aid according to claim 1, further comprising a printed circuit board, wherein the printed circuit board comprises a ground plane, and wherein the antenna and/or the polarization element is coupled to the printed circuit board.

11. The hearing aid according to claim 10, wherein the antenna is connected to the ground plane of the circuit board.

12. The hearing aid according to claim 10, wherein the polarization element is connected to the ground plane of the circuit board.

13. The hearing aid according to claim 1, wherein the antenna is configured to provide an electromagnetic wave that travels along a skin of the user.

14. The hearing aid according to claim 1, wherein the polarization element is embedded within a wall of the hearing aid shell.

15. The hearing aid according to claim 1, wherein the polarization element has a size that corresponds with a longitudinal length of the hearing aid.

16. The hearing aid according to claim 1, wherein at least a portion of the polarization element has a shape that corresponds with a shape of a part of the hearing aid shell.

17. A hearing aid, the hearing aid having a hearing aid shell, the hearing aid shell having a first end and a second end that is opposite from the first end, the hearing aid comprising:

a microphone configured to receive sound;

a processing unit configured to provide a processed audio signal for compensating a hearing loss of a user;

an output transducer for providing an acoustic output, wherein the microphone and the output transducer are coupled to the processing unit;

an antenna, wherein the hearing aid shell comprises an opening at the first end of the hearing aid shell, the hearing aid shell comprises a cover for closing the opening of the hearing aid shell, wherein the antenna is located closer to the first end of the hearing aid shell than to the second end of the hearing aid shell;

a wireless communication unit coupled to the antenna; and a polarization element configured for forming a polarization of the antenna, where the polarization element is between the first end and the second end of the hearing aid shell;

wherein the microphone, the processing unit, the output transducer, the antenna, the wireless communication unit, and the polarization element are in the hearing aid shell;

wherein the first end of the hearing aid shell and the second end of the hearing aid shell define a longitudinal axis of the hearing aid shell, the longitudinal axis of the hearing aid shell corresponding with an ear-to-ear axis of the user when the hearing aid is worn by the user;

wherein the hearing aid shell is a part of an earpiece, wherein at least a part of the polarization element extends in a direction having a primary directional component that corresponds with the longitudinal axis of the hearing aid shell; and wherein the polarization of the antenna is higher in an orthogonal direction to a surface of a head of the user than in a direction parallel to the surface of the head of the user, when the hearing aid is arranged in an ear of the user during use of the hearing aid.

18. The hearing aid according to claim 17, wherein the polarization element is coupled to an interior surface of the hearing aid shell.

19. The hearing aid according to claim 17, wherein the polarization element has a size that corresponds with a longitudinal length of the earpiece.

20. The hearing aid according to claim 17, wherein the at least a part of the polarization element has a shape that corresponds with a shape of a part of the hearing aid shell of the earpiece.

21. The hearing aid according to claim 17, further comprising an additional antenna, the additional antenna being a magnetic antenna.

22. The hearing aid according to claim 17, wherein the hearing aid shell comprises a total inner surface area, and wherein the polarization element covers more than 50% of the total inner surface area of the hearing aid shell.

23. The hearing aid according to claim 1, wherein the polarization element extends along at least a majority of a longitudinal length of the hearing aid shell.

24. The hearing aid according to claim 1, further comprising an additional antenna, the additional antenna being a magnetic antenna.

25. The hearing aid according to claim 1, wherein the at least a part of the polarization element extending in the direction having the primary directional component that corresponds with the ear-to-ear axis of the user comprises more than half of the polarization element.

26. The hearing aid according to claim 1, wherein the hearing aid shell is a part of an earpiece.

27. A hearing aid, the hearing aid having a hearing aid shell, the hearing aid shell having a first end and a second end that is opposite from the first end, the hearing aid comprising:

a microphone configured to receive sound;

a processing unit configured to provide a processed audio signal for compensating a hearing loss of a user;

an output transducer for providing an acoustic output, wherein the microphone and the output transducer are coupled to the processing unit;

a first antenna, wherein the hearing aid shell comprises an opening at the first end of the hearing aid shell, the hearing aid shell comprises a cover for closing the opening of the hearing aid shell, wherein the antenna is located closer to the first end of the hearing aid shell than to the second end of the hearing aid shell;

a second antenna, the second antenna being a magnetic antenna;

a wireless communication unit coupled to the first antenna; and a polarization element configured for forming a polarization of the antenna, wherein at least a part of the polarization element is between the first end and the second end of the hearing aid shell;

wherein the microphone, the processing unit, the output transducer, the first antenna, the second antenna, the wireless communication unit, and the polarization element are in the hearing aid shell;

wherein the first end of the hearing aid shell and the second end of the hearing aid shell define a longitudinal axis of the hearing aid shell, the longitudinal axis of the hearing aid shell corresponding with an ear-to-ear axis of the user when the hearing aid is worn by the user; and wherein the polarization of the antenna is higher in an orthogonal direction to a surface of a head of the user than in a direction parallel to the surface of the head of the user, when the hearing aid is arranged in an ear of the user during use of the hearing aid.

28. The hearing aid according to claim 27, wherein the at least a part of the polarization element extends in a direction having a primary directional component that corresponds with the longitudinal axis of the hearing aid shell.

29. The hearing aid according to claim 28, wherein the at least a part of the polarization element extending in the direction having the primary directional component that corresponds with the longitudinal axis of the hearing aid shell comprises more than half of the polarization element.

30. The hearing aid according to claim 27, wherein the polarization element is on an interior surface of the hearing aid shell, and the at least a part of the polarization element extends in a direction having a primary directional component that corresponds with the longitudinal axis of the hearing aid shell.

31. The hearing aid according to claim 27, wherein the hearing aid shell comprises an inner surface area, and wherein the polarization element covers more than 50% of the inner surface area of the hearing aid shell.

32. A hearing aid, the hearing aid having a hearing aid shell, the hearing aid shell having a first end and a second end that is opposite from the first end, the hearing aid comprising:

a microphone configured to receive sound;

a processing unit configured to provide a processed audio signal for compensating a hearing loss of a user;

an output transducer for providing an acoustic output, wherein the microphone and the output transducer are coupled to the processing unit;

an antenna, wherein the hearing aid shell comprises an opening at the first end of the hearing aid shell, the hearing aid shell comprises a cover for closing the opening of the hearing aid shell, wherein the antenna is located closer to the first end of the hearing aid shell than to the second end of the hearing aid shell;

a wireless communication unit coupled to the antenna; and a polarization element configured for forming a polarization of the antenna, wherein at least a part of the polarization element is between the first end and the second end of the hearing aid shell;

wherein the microphone, the processing unit, the output transducer, the antenna, the wireless communication unit, and the polarization element are in the hearing aid shell;

wherein the first end of the hearing aid shell and the second end of the hearing aid shell define a longitudinal axis of the hearing aid shell, the longitudinal axis of the hearing aid shell corresponding with an ear-to-ear axis of the user when the hearing aid is worn by the user;

wherein the hearing aid shell comprises a total inner surface area, and wherein the polarization element covers more than 50% of the total inner surface area of the hearing aid shell; and wherein the polarization of the antenna is higher in an orthogonal direction to a surface of a head of the user than in a direction parallel to the surface of the head of the user, when the hearing aid is arranged in an ear of the user during use of the hearing aid.

33. The hearing aid according to claim 32, further comprising an additional antenna, the additional antenna being a magnetic antenna.

34. The hearing aid according to claim 32, wherein the polarization element is on an inner surface of the hearing aid shell, and the at least a part of the polarization element extends in a direction having a primary directional component that corresponds with the longitudinal axis of the hearing aid shell.

35. The hearing aid according to claim 34, wherein the at least a part of the polarization element extending in the direction having the primary directional component that corresponds with the longitudinal axis of the hearing aid shell comprises more than half of the polarization element.

36. The hearing aid according to claim 32, wherein the hearing aid shell is a part of an earpiece, and wherein the polarization element covers more than 50% of the total inner surface area of the hearing aid shell of the earpiece.

37. A hearing aid, the hearing aid having a hearing aid shell, the hearing aid shell having a first end and a second end that is opposite from the first end, the hearing aid comprising:

a microphone configured to receive sound;

a processing unit configured to provide a processed audio signal for compensating a hearing loss of a user;

an output transducer for providing an acoustic output, wherein the microphone and the output transducer are coupled to the processing unit;

an antenna, wherein the hearing aid shell comprises an opening at the first end of the hearing aid shell, the hearing aid shell comprises a cover for closing the opening of the hearing aid shell, wherein the antenna is located closer to the first end of the hearing aid shell than to the second end of the hearing aid shell;

a wireless communication unit coupled to the antenna;

a polarization element configured for forming a polarization of the antenna;

wherein the microphone, the processing unit, the output transducer, the antenna, the wireless communication unit, and the polarization element are in the hearing aid shell;

wherein the first end of the hearing aid shell and the second end of the hearing aid shell define a longitudinal axis of the hearing aid shell, the longitudinal axis of the hearing aid shell corresponding with an ear-to-ear axis of the user when the hearing aid is worn by the user;

wherein the hearing aid shell is a part of an earpiece, wherein the polarization element is on an inner surface of the hearing aid shell, and wherein more than half of the polarization element extends in a direction having a primary directional component that corresponds with the longitudinal axis of the hearing aid shell; and wherein the polarization of the antenna is higher in an orthogonal direction to a surface of a head of the user than in a direction parallel to the surface of the head of the user, when the hearing aid is arranged in an ear of the user during use of the hearing aid.

38. The hearing aid according to claim 37, wherein the hearing aid shell comprises a total inner surface area, and wherein the polarization element covers more than 50% of the total inner surface area of the hearing aid shell.

* * * * *